US010525752B2

(12) United States Patent
Wakabayashi

(10) Patent No.: US 10,525,752 B2
(45) Date of Patent: Jan. 7, 2020

(54) PRINTING APPARATUS FOR WEB

(71) Applicant: RISO KAGAKU CORPORATION, Tokyo (JP)

(72) Inventor: Mamoru Wakabayashi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/277,423

(22) Filed: Feb. 15, 2019

(65) Prior Publication Data

US 2019/0263162 A1 Aug. 29, 2019

(30) Foreign Application Priority Data

Feb. 28, 2018 (JP) ..... 2018-035163

(51) Int. Cl.

| | |
|---|---|
| ***B41J 2/175*** | (2006.01) |
| ***B41J 29/393*** | (2006.01) |
| ***B41J 3/42*** | (2006.01) |
| ***B41J 3/60*** | (2006.01) |
| ***B41J 11/00*** | (2006.01) |
| ***B41J 11/42*** | (2006.01) |
| ***B41J 15/16*** | (2006.01) |

(52) U.S. Cl.

CPC ..... *B41J 29/393* (2013.01); *B41J 3/42* (2013.01); *B41J 3/60* (2013.01); *B41J 11/008* (2013.01); *B41J 11/42* (2013.01); *B41J 15/165* (2013.01)

(58) Field of Classification Search

CPC ..... B41J 2/17596; B41J 11/42
USPC ..... 347/16, 85
See application file for complete search history.

(56) References Cited

U.S. PATENT DOCUMENTS

| | | | | |
|---|---|---|---|---|
| 9,415,960 | B2 * | 8/2016 | Asano | B65H 5/068 |
| 9,457,600 | B2 * | 10/2016 | Horaguchi | B41J 15/005 |
| 2008/0124158 | A1 * | 5/2008 | Folkins | G03G 15/0152 399/396 |
| 2013/0042807 | A1 * | 2/2013 | Noguchi | B65H 18/10 118/500 |
| 2013/0293640 | A1 * | 11/2013 | McCallum | B41J 2/175 347/85 |
| 2014/0204144 | A1 * | 7/2014 | Ishikawa | B41J 3/60 347/16 |

FOREIGN PATENT DOCUMENTS

JP 2003-63072 3/2003

* cited by examiner

*Primary Examiner* — Lam S Nguyen
(74) *Attorney, Agent, or Firm* — Greenblum & Bernstein, P.L.C.

(57) ABSTRACT

A controller: generates a first corrected pulse signal by correcting a received first pulse signal or generate a second corrected pulse signal by correcting a received second pulse signal, based on a difference value between a first rotation cycle of a first roller and a second rotation cycle of a second roller such that a difference between a first pulse cycle of the received first pulse signal and a second pulse cycle of the received second pulse signal is reduced; upon generating the first corrected pulse signal, controls first print timings in respective first print mechanisms of a first printer based on the generated first corrected pulse signal; and upon generating the second corrected pulse signal, controls second print timings in respective second print mechanisms of a second printer based on the generated second corrected pulse signal.

2 Claims, 11 Drawing Sheets

PRINTING APPARATUS FOR WEB

CROSS REFERENCE TO RELATED APPLICATION

This application is based upon and claims the benefit of priority from the prior Japanese Patent Application No. 2018-035163, filed on Feb. 28, 2018, the entire contents of which are incorporated herein by reference.

BACKGROUND

1. Technical Field

The disclosure relates to a printing apparatus which performs printing on a web.

2. Related Art

There is known a printing apparatus which prints an image on a long web being a print medium by ejecting inks from inkjet heads to the web while conveying it.

Japanese Patent Application Publication No. 2003-63072 proposes a printing apparatus which includes a printer for a front surface of a web and a printer for a back surface disposed downstream of the printer for the front surface in a conveyance direction of the web and which can perform printing on both surfaces of the web.

As a printing apparatus capable of performing printing on both surfaces as described above, there is an apparatus in which the printer for the front surface and the printer for the back surface each include inkjet heads which eject inks of different colors. The inkjet heads in each printer are aliened in the conveyance direction of the web.

In such a printing apparatus, an ejection timing of the ink in each inkjet head is controlled based on an output pulse signal of an encoder connected to a roller which rotates in synchronization with the web being conveyed.

SUMMARY

In the ejection timing control as described above, accuracy of an ink landing position decreases as the distance from the encoder to the inkjet head increases, due to an effect of stretching and shrinking of the web and the like. Accordingly, for example, when the encoder is disposed near and upstream of the printer for the front surface side, misalignment of the ink landing positions may occur between the inkjet heads in the printer for the back surface far from the encoder due to the decrease in the ink landing position accuracy. Specifically, in some cases, color misregistration occurs in the image printed on the back surface and print image quality decreases.

The disclosure is related to a printing apparatus which can reduce misalignment between images printed on a front surface and a back surface of a web while suppressing a decrease in image quality.

A printing apparatus in accordance with some embodiments includes: a first printer including first print mechanisms aligned in a conveyance direction of a web, the first printer being configured to print a first image on a first surface of the web being conveyed by using the first print mechanisms; a second printer including second sprint mechanisms aligned in the conveyance direction the second printer being configured to print a second image on a second surface of the web being conveyed by using the second print mechanisms; a first roller configured to rotate in synchronization with the web being conveyed; a second roller configured to rotate in synchronization with the web being conveyed; a first encoder configured to output a first pulse signal depending on a rotation angle of the first roller; a second encoder configured to output a second pulse signal depending on a rotation angle of the second roller; and a controller. The controller is configured to: receive the first pulse signal outputted from the first encoder and the second pulse signal outputted from the second encoder; generate a first corrected pulse signal by correcting the received first pulse signal or generate a second corrected pulse signal by correcting the received second pulse signal, based on a difference value between a first rotation cycle of the first roller and a second rotation cycle of the second roller such that a difference between a first pulse cycle of the received first pulse signal and a second pulse cycle of the received second pulse signal is reduced; upon generating the first corrected pulse signal, control first print timings in the respective first print mechanisms of the first printer based on the generated first corrected pulse signal; and upon generating the second corrected pulse signal, control second print timings in the respective second print mechanisms of the second printer based on the generated second corrected pulse signal.

According to the aforementioned configuration, it is possible to reduce misalignment between images printed on a front surface and a back surface of the web while suppressing a decrease in image quality.

DETAILED DESCRIPTION

Figure 1:
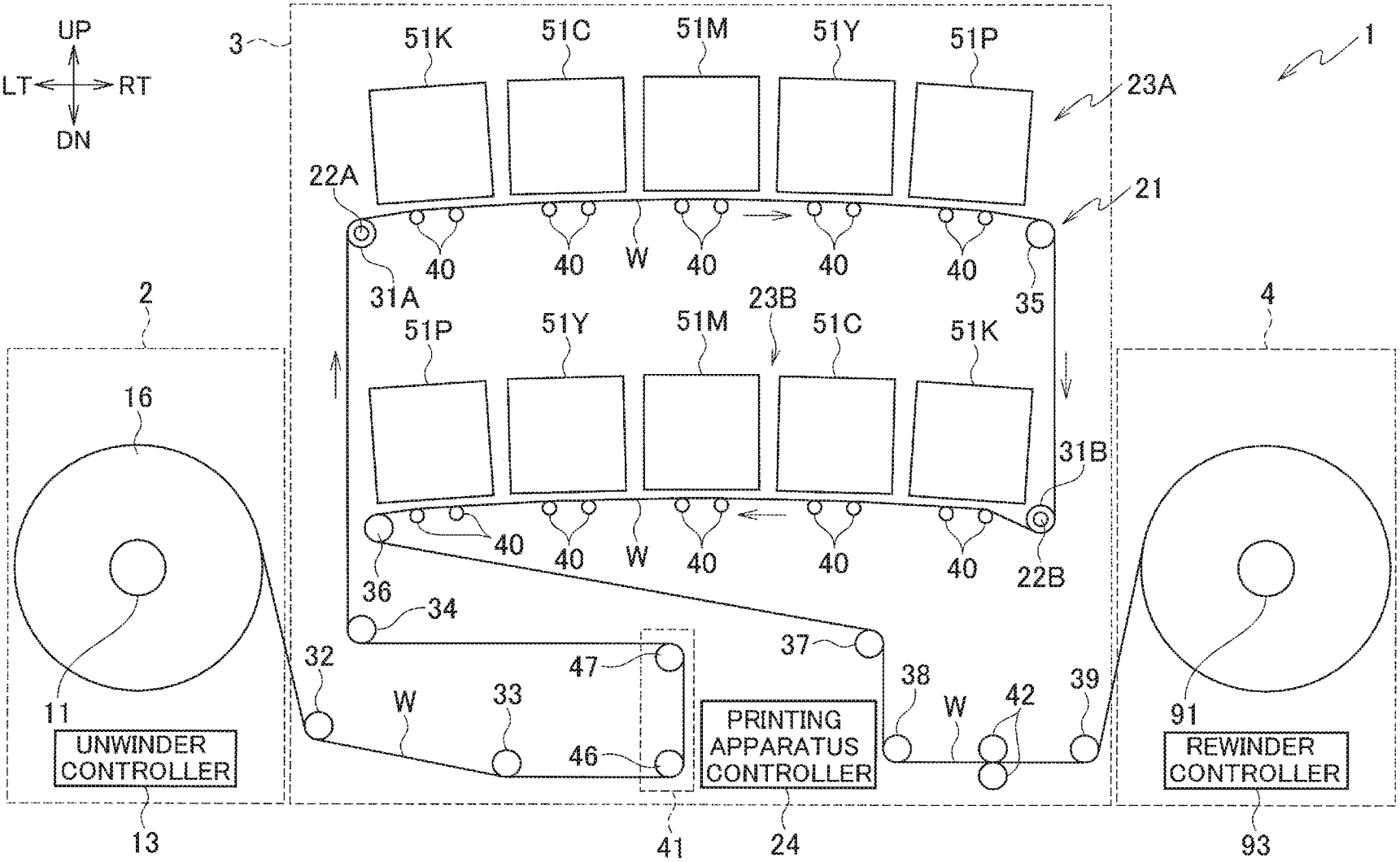
FIG. 1 is a schematic configuration diagram of a print system including a printing apparatus according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
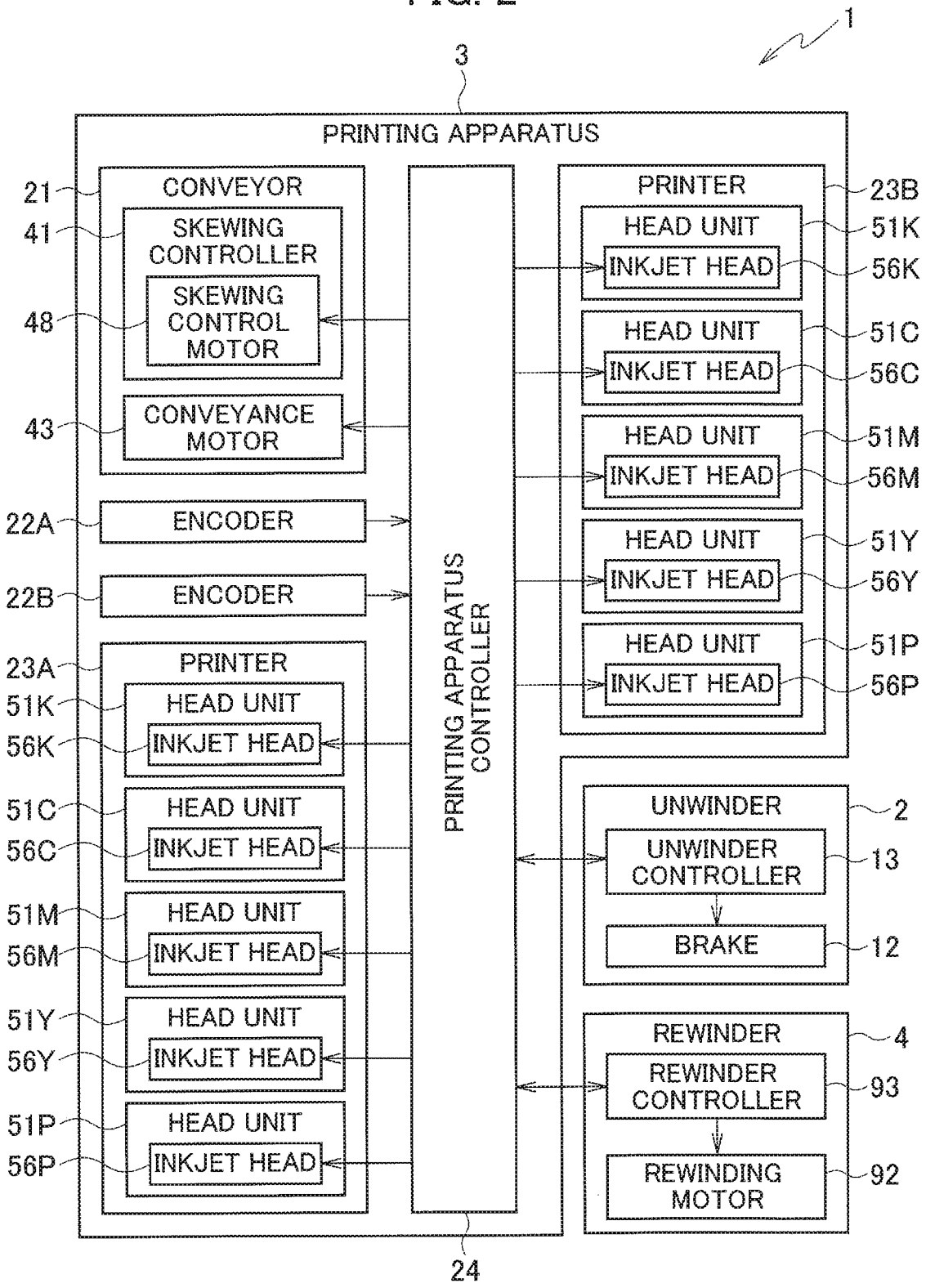
FIG. 2 is a control block diagram of the print system illustrated in FIG. 1.
Figure 3:
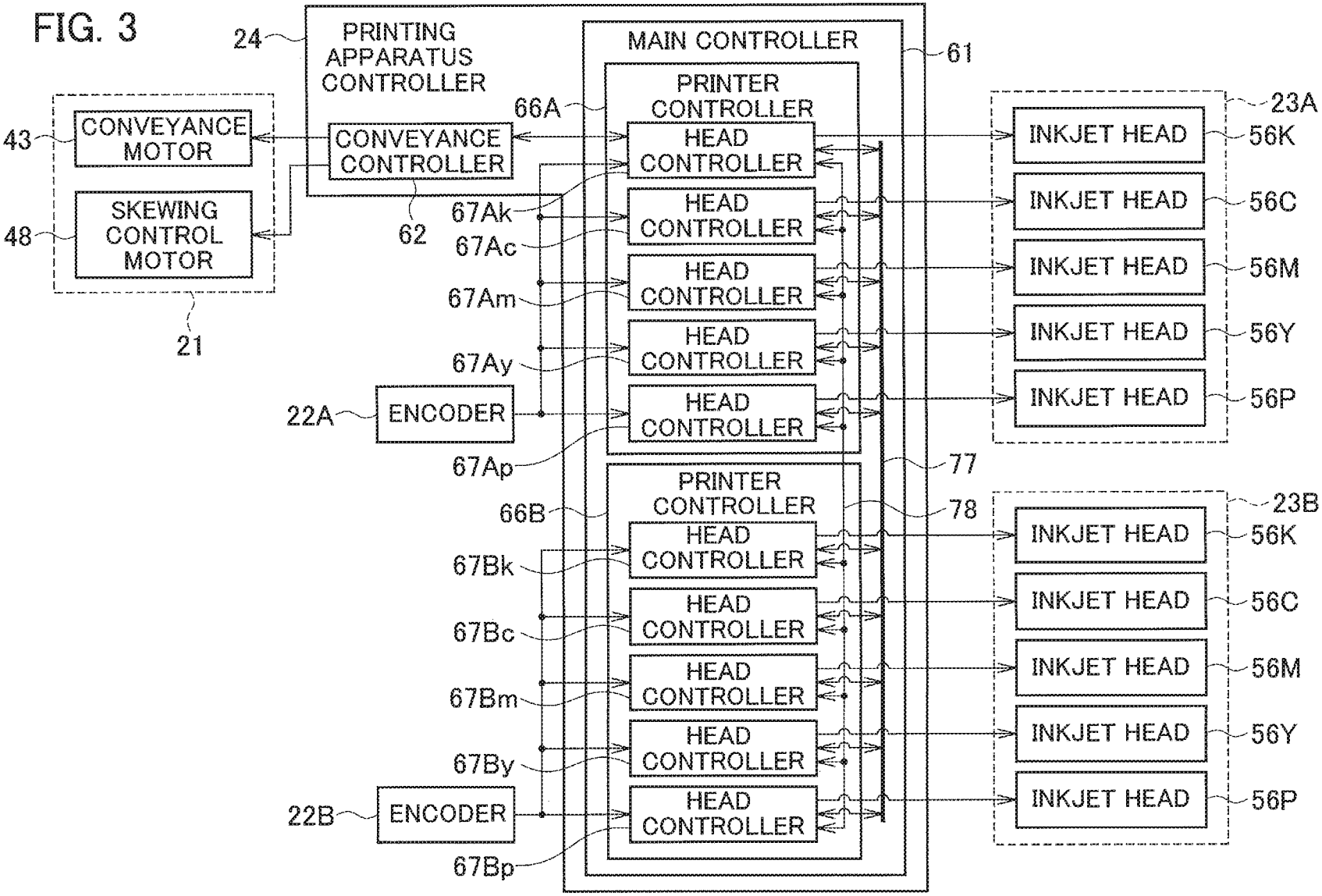
FIG. 3 is a block diagram-illustrating a configuration of a printing apparatus controller included in a printing apparatus of the print system illustrated in FIG. 1.
Figure 4:
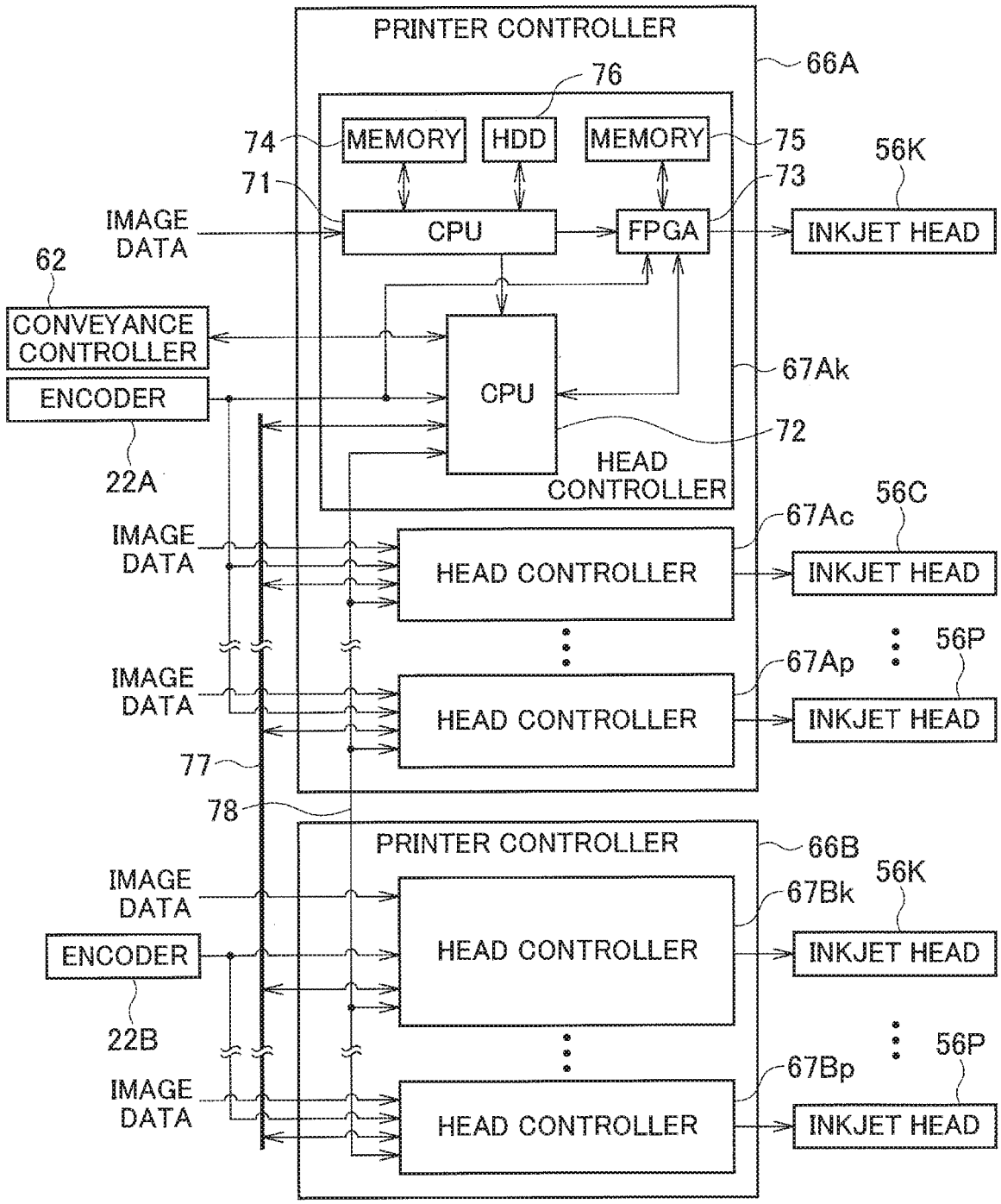
FIG. 4 is a block diagram illustrating a configuration of head controllers included in the printing apparatus controller illustrated in FIG. 3.
Figure 5:
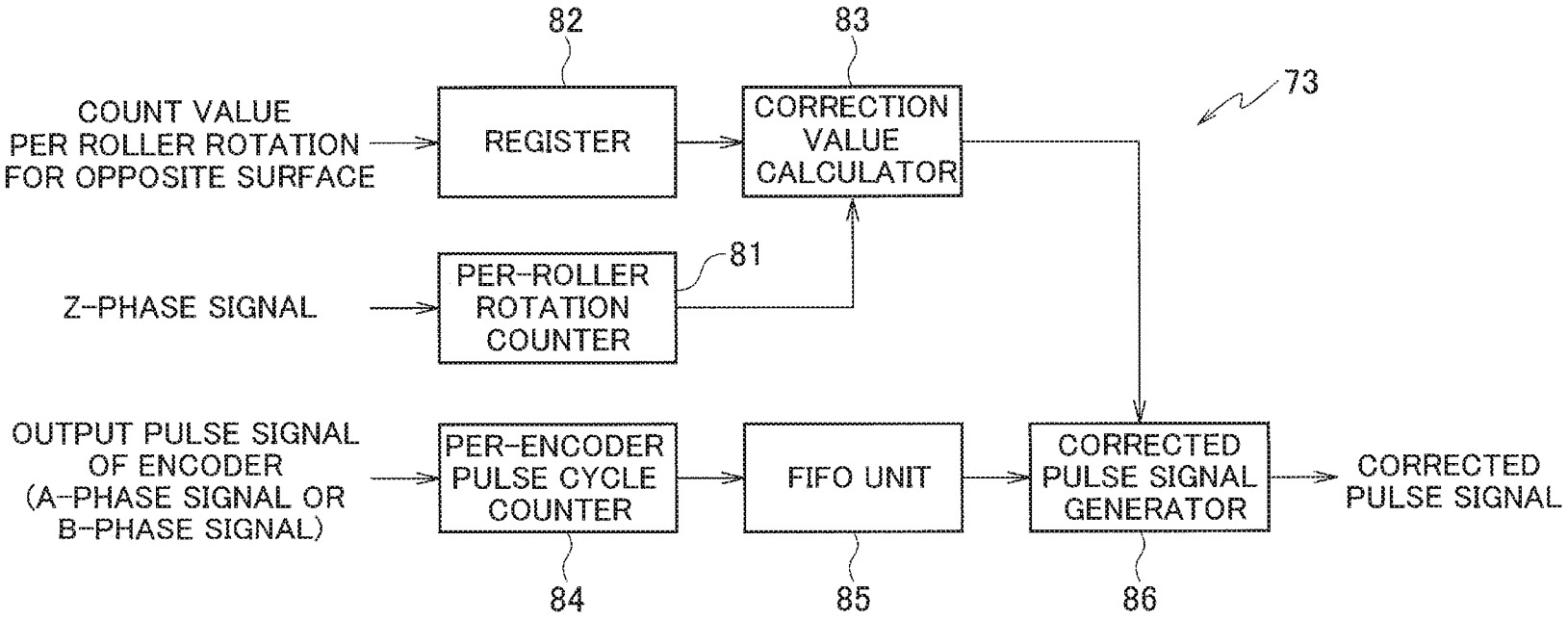
FIG. 5 is a functional block diagram of a FPGA included in each of the head controllers illustrated in FIG. 4.

FIG. 1 is a schematic configuration view of a print system 1 including a printing apparatus 3 according an embodiment of the present invention. FIG. 2 is a control block diagram of the print system 1 illustrated in FIG. 1. FIG. 3 is a block diagram illustrating a configuration of a printing apparatus controller 24 included in the printing apparatus 3 of the print system 1 illustrated in FIG. 1. FIG. 4 is a block diagram illustrating a configuration of head controllers 67 included in printer controllers 66. FIG. 5 is a functional block diagram of a FPGA included in each head controller 67. In the following description, a direction orthogonal to the sheet surface of FIG. 1 is referred to as front-rear direction. Moreover, up, down, left, and right in the sheet surface of FIG. 1 are referred to as directions of up, down, left, and right. In FIG. 1, the directions of right, left, up, and down are denoted by RT, LT, UP, and DN.

As illustrated in FIGS. 1 and 2, the print system 1 includes an unwinder 2, the printing apparatus 3, and a rewinder 4.

The unwinder 2 unwinds a web W being a long print medium made of film, paper, or the like to the printing apparatus 3. The unwinder 2 includes a web roll support shaft 11, a brake 12, and an unwinder controller 13.

The web roll support shaft 11 rotatably supports a web roll 16. The web roll 16 is the web W wound into a roll.

The brake 12 applies brake to the web roll support shaft 11. Tension is thereby applied to the web W between the web roll 16 and a pair of conveyance rollers 42 of the printing apparatus 3 to be described later.

The unwinder controller 13 controls the brake 12. The unwinder controller 13 includes a CPU, a memory, a hard disk drive, and the like.

The printing apparatus 3 prints images on the web W while conveying the web W unwound from the web roll 16. The printing apparatus 3 includes a conveyor 21, encoders 22A, 22B (each of which is a first or second encoder), printers 23A, 23B (each of which is a first or second printer) and the printing apparatus controller (controller) 24. Note that members such as the encoders 22A, 22B may be collectively referred to by omitting the alphabets attached to the reference numeral.

The conveyor 21 conveys the web W unwound from the web roll 16 to the rewinder 4. The conveyor 21 includes encoder rollers 31A, 31B (each of which is a first or second roller), guide rollers 32 to 39, 20 under-head rollers 40, a skewing controller 41, the pair of conveyance rollers 42, and a conveyance motor 43.

The encoder rollers 31A, 31B, the guide rollers 32 to 39, the under-head rollers 40, the conveyance rollers 42, and skewing control rollers 46, 47 of the skewing controller 41 to be described later form a conveyance route of the web W in the conveyor 21.

The encoder rollers 31A, 31B are rollers which guide the web W near and upstream of the printers 23A, 23B in the conveyance direction of the web W, respectively, and are rollers in which the encoders 22A, 22B are installed, respectively. The encoder rollers 31A, 31B rotate by following the web W being conveyed. The encoder rollers 31A, 31B are rollers designed to have the same diameter.

The guide rollers 32 to 39 are rollers which guide the web W conveyed inside the printing apparatus 3. The guide rollers 32 to 39 rotate by following the web W being conveyed.

The guide roller 32 is disposed in a left end portion of a lower portion of the printing apparatus 3. The guide roller 33 is disposed between the guide roller 32 and the skewing control roller 46 of the skewing controller 41 to be described later. The guide roller 34 is disposed at a position which is slightly above and on the left side of the skewing control roller 47 of the skewing controller 41 to be described later and which is below the encoder roller 31A. The guide roller 35 is disposed near and downstream of the printer 23A, between the encoder rollers 31A, 31B, at substantially the same height as the encoder roller 31A.

The guide roller 36 is disposed near and downstream of the printer 23B, at substantially the same height as the encoder roller 31B. The guide roller 37 is disposed on the lower right side of the guide roller 36. The guide roller 38 is disposed below and slightly on the right side of the guide roller 37. The guide roller 39 is disposed on the right side of the guide roller 38, in a right end portion of the lower portion of the printing apparatus 3.

The under-head rollers 40 support the web W under head units 51 to be described later in an area between the encoder roller 31A and the guide roller 35 and an area between the encoder roller 31B and the guide roller 36. Ten under-head rollers 40 are disposed in each of the area between the encoder roller 31A and the guide roller 35 and the area between the encoder roller 31B and the guide roller 36. Moreover, two under-head rollers 40 are disposed just below each head unit 51. The under-head rollers 40 rotate by following the web W being conveyed.

The skewing controller 41 corrects skewing which is fluctuation in the position of the web W in a width direction (front-rear direction) orthogonal to the conveyance direction of the web W. The skewing controller 41 includes the skewing control rollers 46, 47 and a skewing control motor 48.

The skewing control rollers 46, 47 are rollers for guiding the web W and correcting the skewing of the web W. The skewing control rollers 46, 47 rotate by following the web W being conveyed. The skewing control rollers 46, 47 move the web W in the width direction by being turned to tilt with respect to the width direction of the web W as viewed in the left-right direction and thereby correct the skewing. The skewing control roller 46 is disposed on the right side of the guide roller 33. The skewing control roller 47 is disposed above the skewing control roller 46.

The skewing control motor 48 turns the skewing control rollers 46, 47 about a rotation axis parallel to the left-right direction.

The pair of conveyance rollers 42 conveys the web W toward the rewinder 4 while nipping the web W. The pair of conveyance rollers 42 is disposed between the guide rollers 38, 49.

The conveyance motor 43 rotationally drives the conveyance rollers 42.

The encoders 22A, 22B are installed in the encoder rollers 31A, 31B, respectively, and output pulse signals (A-phase signal, B-phase signal) depending on rotation angles of the encoder rollers 31A, 31B which rotate by following (rotate in synchronization with) the web W being conveyed. Moreover, the encoders 22A, 22B each output a Z-phase signal which is a reference signal indicating one rotation of a corresponding one of the encoder rollers 31A, 31B.

The printer 23A prints images on a front surface (first or second surface) of the web W. The printer 23A is disposed near and above the web K between the encoder roller 31A and the guide roller 35. The printer 23A includes head units 51K, 51C, 51M, 51Y, 51P. Note that the head units 51K, 51C, 51M, 51Y, 51P are sometimes collectively referred to as head units 51 for the sake of description.

The head units 51K, 51C, 51M, 51Y, 51P include inkjet heads (print mechanisms) 56K, 56C, 56M, 56Y, 56P, respectively. The head units 51K, 51C, 51M, 51Y, 51P are aligned in a sub-scanning direction (left-right direction) which is the conveyance direction of the web W. Accordingly, the inkjet heads 56K, 56C, 56M, 56Y, 56P are also aligned in the sub-scanning direction. Note that the inkjet heads 56K, 56C, 56M, 56Y, 56P are sometimes collectively referred to as inkjet heads 56 for the sake of description.

The inkjet heads 56K, 56C, 56M, 56Y, 56P print images by ejecting inks of black (K), cyan (C), magenta (N), yellow (Y), and an extra ink color to the web W, respectively. Red, light cyan, or the like is used as the extra ink color.

The inkjet heads 56 each include nozzles (not illustrated) which are arranged in the main scanning direction (front-rear direction) and which are opened on an ink ejection surface facing the web W and eject the inks from the nozzles.

The printer 23B prints images on a back surface (second or first surface) of the web W. The printer 23B is disposed below the printer 23A, near and above the web W between the encoder roller 31B and the guide roller 36. In other words, the printer 23B is disposed downstream of the printer 23A in the conveyance direction of the web W. The printer 23B includes head units 51K, 51C, 51M, 51Y, 51P, like the printer 23A.

The configuration of the printer 23B is right-left reversed to the configuration of the printer 23A. The configuration of the printer 23B is the same as that of the printer 23A except for being right-left reversed.

The printing apparatus controller 24 controls operations of the units in the printing apparatus 3. As illustrated in FIG. 3, the printing apparatus controller 24 includes a main controller 61 and a conveyance controller 62.

The main controller 61 is responsible for control of the entire printing apparatus 3. The main controller 61 includes printer controllers 66A, 66B (each of which is a first or second printer controller). Note that the printer controllers 66A, 66B are sometimes collectively referred to as printer controllers 66 for the sake of description.

The printer controllers 66A, 66B control the printers 23A, 23B, respectively, to cause them to print images. Specifically, the printer controller 66A performs print control for the front surface of the web W and the printer controller 665 performs print control for the back surface of the web W. The output pulse signals and Z-phase signals of the encoders 22A, 22B are inputted into the printer controllers 66A, 66B. The printer controllers 66A, 66B control ink ejection timings (print timings) of the inkjet heads 56 in the printers 23A, 23B, based on the output pulse signals of the encoders 22A, 22B, respectively.

Moreover, the printer controllers 66A, 66B correct the output pulse signals of the encoders 22A, 22B based on a difference value between the rotation cycles of the encoder rollers 31A, 31B such that a difference in a pulse cycle between both output pulse signals is reduced.

The aforementioned difference value between the rotation cycles of the encoder rollers 31A, 31B is due to a difference in the outer circumferential length between the encoder rollers 31A, 31B.

Although the encoder rollers 31A, 31B are rollers designed to have the same diameter, the outer circumferential length of the encoder roller 31A is different from that of the encoder roller 31B due to a mechanical tolerance. When the outer circumferential length of the encoder roller 31A is different from that of the encoder roller 31B, the conveyance amount of the web W depending on the number of output pulses of the encoder 22A is different from that of the encoder 22B. A print length of an image printed on the front surface of the web W by the printer 23A based on the output pulse signal of the encoder 22A is thereby different from a print length of an image printed on the back surface of the web W by the printer 23B based on the output pulse signal of the encoder 22B. Then, as the printing proceeds, an amount of misalignment between the images printed on the front and back surfaces of the web W gradually increases.

Figure 6:
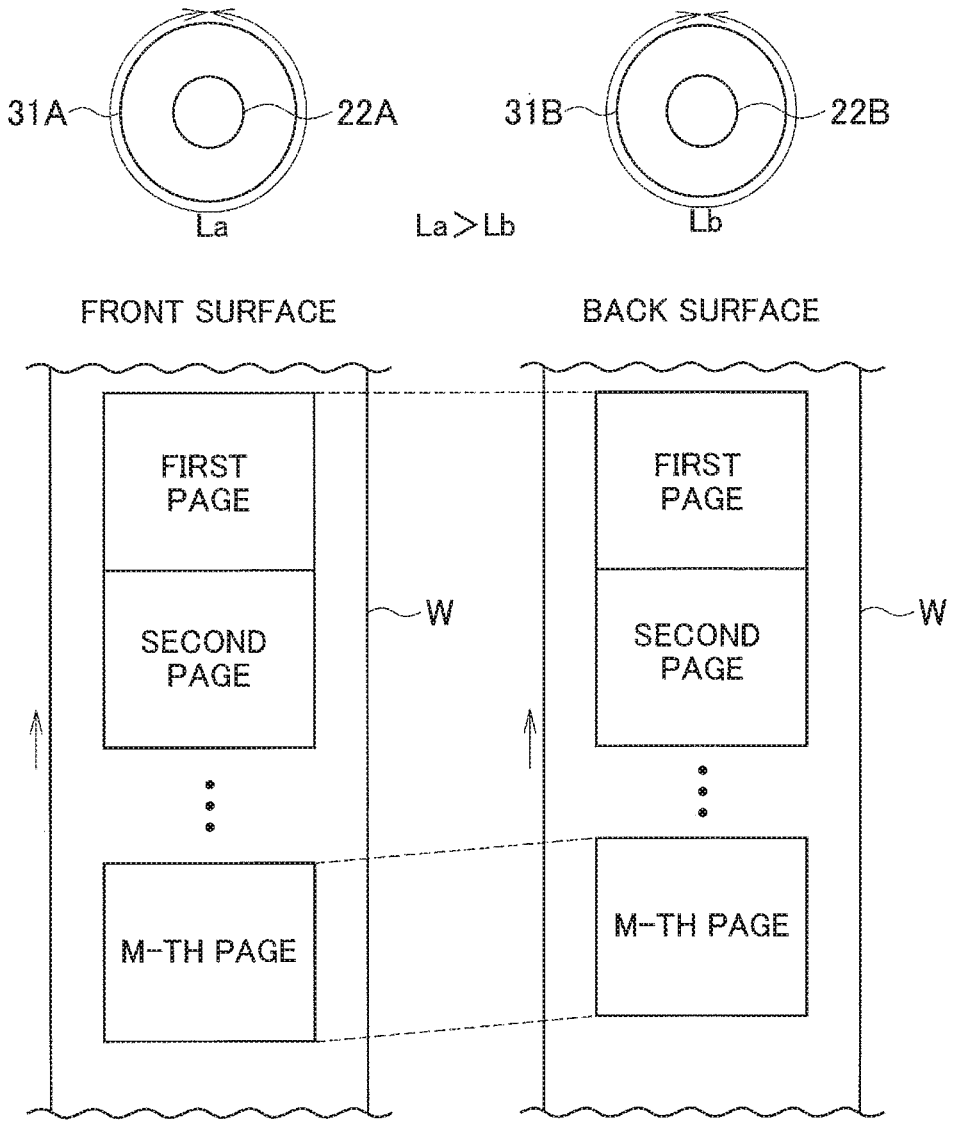
FIG. 6 is a view explaining misalignment between images printed on a front surface and a back surface of a web.

For example, when the outer circumferential length La of the encoder roller 31A is larger than the cuter circumferential length Lb of the encoder roller 31B, as illustrated in FIG. 6, the print length on the front surface of the web W is longer than that on the back surface and pages on the front surface are shifted upstream relative to pages on the back surface corresponding to the pages on the front surface.

The correction of the output pulse signals of the encoders 22A, 22B based on the difference value between the rotation cycles of the encoder rollers 31A, 31B is performed to suppress misalignment between images printed on the front and back surfaces of the web W as in FIG. 6.

Returning to the description of the printer controllers 66, as illustrated in FIG. 3, the printer controller 66A includes head controllers 67Ak, 67Ac, 67Am, 67Ay, 67Ap. The head controllers 67Ak, 67Ac, 67Am, 67Ay, 67Ap control drive of the inkjet heads 56K, 56C, 56M, 56Y, 56P in the printer 23A, respectively.

The printer controller 66B includes head controllers 67Bk, 67Bc, 67Bm, 67By, 67Bp. The head controllers 67Bk, 67Bc, 67Bm, 67By, 67Bp control drive of the inkjet heads 56K, 56C, 56M, 56Y, 56P in the printer 23B, respectively. Note that the head controllers 67Ak, 67Ac, 67Am, 67Ay, 67Ap, 67Bk, 67Bc, 67Bm, 67By, 67Bp are sometimes collectively referred to as head controllers 67 for the sake of description.

The head controllers 67 of the printer controllers 66A, 66B all have the same configuration except for the point that only the head controller 67Ak in the printer controller 66A is connected to the conveyance controller 62. As illustrated in FIG. 4, each of the head controllers 67 includes Central Processing Units (CPUs) 71, 72, a Field Programmable Gate Array (FPGA) 73, memories 74, 75, and a Hard Disk Drive (HDD) 76.

When the CPU 71 receives compressed image from an external apparatus, the CPU 71 performs processing of decompressing the received image data.

In this case, each head controller 67 receives the compressed image data of a target to be printed by the inkjet head 56 control led by the head controller 67. For example, the head controller 67Ak receives image data for causing the inkjet head 56K of the printer 23A to eject the black ink to the front surface of the web W. Moreover, for example, the head controller 67Bc receives image data for causing the inkjet head 56C of the printer 23B to eject the cyan ink to the back surface of the web W.

The CPU 72 obtains a later-described count value per roller rotation Nb which indicates the rotation cycle of the encoder roller 31 for the opposite surface, and supplies the count value per roller rotation Nb to the FPGA 73. Moreover, the CPU 72 in each of the head controller 67Ak of the printer controller 66A and the head controller 67Bk of the printer controller 66B obtains, from the FPGA 73, a later-described count value per roller rotation Na which indicates the rotation cycle of the encoder roller 31 measured by the printer controller 66 including the CPU 72 itself, and sends the count value per roller rotation Na to the head controllers 67 of the printer controller (other printer controller) 66 for the opposite surface. Moreover, the CPU 72 of the head controller 67Ak instructs the conveyance controller 62 to start the conveyance of the web W when the image data is received and the printing is to be started.

The CPUs 72 of the head controllers 67 in the printer controllers 66A, 66B are connected to be capable of communicating with each other via a communication bus 77 (communication line) such as a Controller Area Network (CAN). The CPUs 72 of the head controllers 67Ak, 67Bk send the aforementioned count value per roller rotations Na via the communication bus 77. Moreover, the CPUs 72 of the head controllers 61 in the printer controllers 66A, 66B are connected to each other by a signal line 78. When the CPU 72 of the head controller 67Ak instructs the conveyance controller 62 to start the conveyance of the web W, the CPU 72 of the head controller 67Ak notifies the CPUs 72 of the other head controllers 67 of the start of the conveyance of the web W via the signal line 78.

The FPGA 73 causes the ink to be ejected from the nozzles of the corresponding inkjet head 56 based on the image data. In this case, the FPGA 73 controls election timings of the ink in the inkjet head 56 based on the output pulse signal of the corresponding encoder 22.

Moreover, the FPGA 73 corrects the pulse cycle in the output pulse signal of the encoder 22 inputted into the FPGA 73 itself based on the difference value between the rotation cycles of the encoder rollers 31A, 31B such that the difference in the pulse cycle between the output pulse signals of the encoders 22A, 22B is reduced.

As illustrated in FIG. 5, the FPGA 73 includes a per-roller rotation counter a register 82, a correction value calculator 83, a per-encoder pulse cycle counter 84, a First-In First-Out (FIFO) unit 85, and a corrected pulse signal generator 86. In FIG. 5, only the configurations relating to the correction of the output pulse signal of the encoder 22 is illustrated.

The per-roller rotation counter 81 measures the rotation cycle of the encoder roller 31 installed in the encoder 22 corresponding to the head controller 67 including the per-roller rotation counter 81 itself, by using the Z-phase signal of this encoder 22.

The register 82 holds the count value per roller rotation Nb for the opposite surface which is sent from the printer controller 66 for the opposite surface. The count value per roller rotation Nb held by the register 82 indicates the rotation cycle of the encoder roller 31 different from the encoder roller 31 installed in the encoder 22 corresponding to the head controller 67 including this register 82.

The correction value calculator 83 calculates a correction value H for correcting the output pulse signal of the encoder 22 based on the difference value between the count value per roller rotation Na indicating the rotation cycle of the roller measured by the per-roller rotation counter 81 and the count value per roller rotation Nb for the opposite surface.

The per-encoder pulse cycle counter 84 measures the pulse cycles in the output pulse signal of the encoder 22 inputted into the head controller 67 including the per-encoder pulse cycle counter 84 itself one by one. The per-encoder pulse cycle counter 84 outputs pieces of pulse cycle data indicating the respective measured pulse cycles in order to the FIFO unit 85.

The FIFO unit 85 holds the pieces of pulse cycle data received from the per-encoder pulse cycle counter 84 in the order of reception and outputs them in the order of reception.

The corrected pulse signal generator 86 generates a corrected pulse signal which is a signal obtained by correcting the pulse cycle in the output pulse signal of the encoder 22 based on the correction value H calculated by the correction value calculator 83 and the pulse cycle data obtained from the FIFO unit 85.

Returning to FIG. 4, the memory 74 is used as a work area of the CPU 71, The memory 75 is used as a work area of the FPGA 73. The HDD 76 stores various programs and the like.

The conveyance controller 62 controls conveyance of the web W by the conveyor 21. The conveyance controller 62 includes a CPU, a memory, and the like.

The rewinder 4 rewinds the web W subjected to printing in the printing apparatus 3. The rewinder 4 includes a rewinding shaft 91, a rewinding motor 92, and a rewinder controller 93.

The rewinding shaft 91 rewinds and holds the web W.

The rewinding motor 92 rotates the rewinding shaft 91 clockwise in FIG. 1. Rotation of the rewinding shaft 91 causes the web W to be rewound on the rewinding shaft 91.

The rewinder controller 93 controls drive of the rewinding motor 92. The rewinder controller 93 includes a CPU, a memory, a hard disk drive, and the like.

Next, operations of the print system 1 are described.

When printing is to be performed in the print system 1, each head controller 67 in the printing apparatus controller 24 receives the compressed image data of the target to be printed by the inkjet head 56 controlled by this head controller 67, from the external apparatus.

When receiving the compressed image data, each of the CPUs in the printer controllers 66 performs processing of decompressing the compressed image data. Then, the CPU 71 sends the decompressed image data to the FPGA 73. Moreover, the CPU 71 sends header information sent together with the image data to the CPU 72. The header information includes various pieces of print setting information such as page size and print resolution. The CPU 72 performs various types of print setting for the FPGA 73 based on the header information.

When receiving the header information, the CPU 72 of the head controller 67Ak instructs the conveyance controller 62 to start the conveyance of the web W and notifies the CPUs 72 of the other head controllers 67 of the start of the conveyance of the web W via the signal line 78. Moreover, the CPU 72 of the head controller 67Ak instructs the unwinder controller 13 and the rewinder controller 93 to start the conveyance of the web W.

When the start of conveyance of the web W is instructed, the unwinder controller 13 causes the brake 12 to start output of brake force. Moreover, the conveyance controller 62 of the printing apparatus controller 24 causes the conveyance motor 43 to start the drive of the conveyance rollers 42. Furthermore, the rewinder controller 93 causes the rewinding motor 92 to start the drive of the rewinding shaft 91. Unwinding and conveyance of the web W from the web roll 16 is thereby started. Applying brake to the web roll support shaft 11 with the brake 12 causes the web W to be conveyed with tension applied to the web W between the web roll 16 and the pair of conveyance rollers 42.

When the conveyance of the web W is started, the web W is accelerated at predetermined acceleration until the conveyance speed reaches a predetermined print conveyance speed. When the conveyance speed of the web U reaches the print conveyance speed, the conveyance controller 62 controls driving of the conveyance rollers 42 performed by the conveyance motor 43 such that constant speed conveyance of the web W is performed at the print conveyance speed.

After the constant speed conveyance of the web U at the print conveyance speed is started, the CPU 72 of each head controller 67 instructs the FPGA 73 to start the printing. In this case, the CPU 72 determines a print start timing of the inkjet head 56, set to come after the transition to the constant speed conveyance of the web W, based on the number of output pluses of the encoder 22 outputted since the start of conveyance of the web W.

When the print start is instructed, the FPGA 73 causes the ink to be ejected from the nozzles of the inkjet head 56 based on the image data and executes the printing of each page. In this case, the FPGA 73 controls timings of electing the ink based on the image data in the inkjet head 56, based on the output pulse signal of the encoder 22.

In this print operation, the printer controllers 66A, 66B correct the output pulse signals of the encoders 22A, 22B based on the difference value between the rotation cycles of the encoder rollers 31A, 31B such that the difference in the pulse cycle between both output pulse signals is reduced.

In order to correct the output pulse signals of the encoders 22, the printer controllers 66A, 66B each measure the rotation cycle of the corresponding one of the encoder rollers 31A, 31B.

Figure 7:
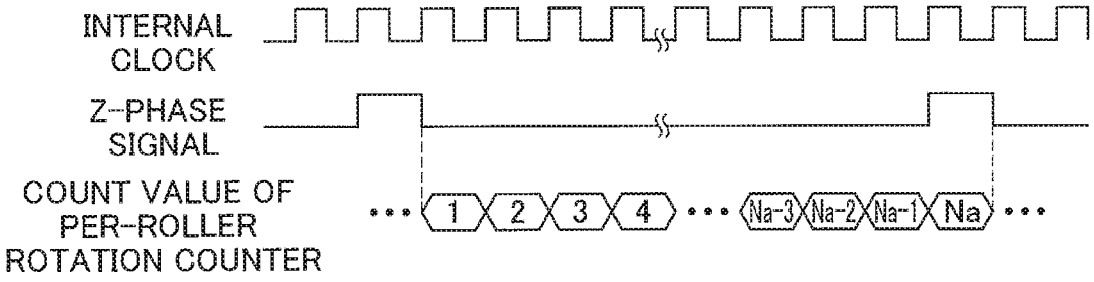
FIG. 7 is a view explaining an operation of measuring a rotation cycle of an encoder roller.

Specifically, as illustrated in FIG. 7, the per-roller rotation counter 31 in each of the head controllers 67 of the printer controllers 66 counts pulses of an internal clock in the FPGA 73 to measure time between the pulses of the Z-phase signal of the encoder 22 corresponding to the head controller 67 including the per-roller rotation counter 81 itself. One pulse of Z-phase signal is outputted per rotation of the encoder roller 31.

Here, the count value of the internal clock pulses in a period between the pulses of the Z-phase signal obtained by the per-roller rotation counter 81 is referred to as count value per roller rotation Na. The count value per roller rotation Na obtained by the per-roller rotation counter 81 indicates the rotation cycle of the encoder roller 31 in which the encoder 22 corresponding to this per-roller rotation counter 81 is installed. Specifically, the count value per roller rotation Na obtained by the per-roller rotation counter 81 in each of the head controllers 67 of the printer controller 66A indicates the rotation cycle of the encoder roller 31A. Meanwhile, the count value per roller rotation Na obtained by the per-roller rotation counter 81 in each of the head controllers 67 of the printer controller 66B indicates the rotation cycle of the encoder roller 31B.

Then, each of the printer controllers 66A, 66B sends the measured count value per roller rotation Na to the other printer controller.

Processing in which each printer controller 66 sends the count value per roller rotation Na is described with reference to the flowchart of FIG. 8.

Sending of the count value per roller rotation Na is performed by one of the head controllers 67 in each of the printer controllers 66A, 66B. In the embodiment, as described above, the head controller 67Ak in the printer controller 66A and the head controller 67Bk in the printer controller 66B each send the count value per roller rotation Na obtained therein to the printer controller 66 for the opposite surface.

Figure 8:
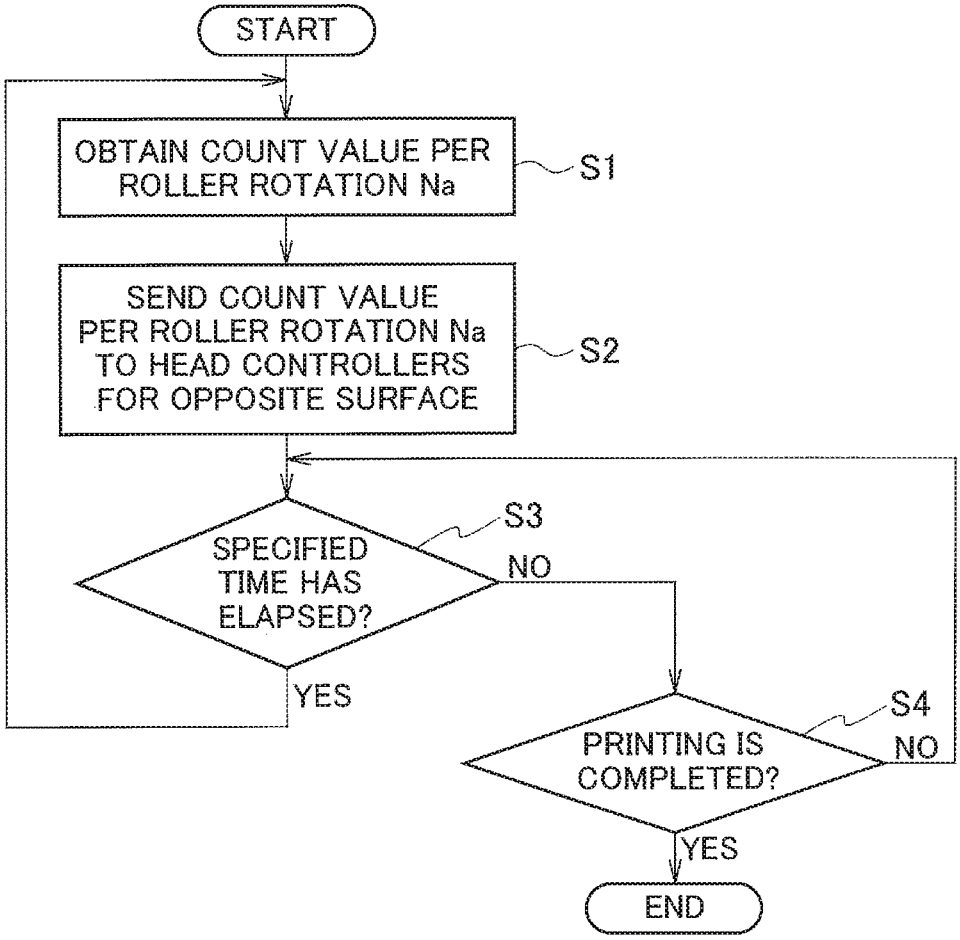
FIG. 8 is a flowchart of processing in which a printer controller sends the rotation cycle of the encoder roller.

The processing in the flowchart of FIG. 8 starts when the constant speed conveyance of the web W at the print conveyance speed start. The processing performed by the head controller 67Ak in the printer controller 66A is described below.

In step S1 of FIG. 8, the CPU 72 of the head controller 67Ak obtains the latest count value per roller rotation Na from the per-roller rotation counter 81 in the FPGA 73 of the head controller 67Ak.

Then, in step S2, the CPU 72 of the head controller 67Ak sends the obtained count value per roller rotation Na to the head controllers 67 for the opposite surface, that is the head controllers 67 of the printer controller 66B via the communication bus 77.

Next, in step S3, the CPU 72 of the head controller 67Ak determines whether a specified time (for example, 100 msec) has elapsed from the sending of the latest count value per roller rotation Na.

When the CPU 72 of the head controller 67Ak determines that the specified time has elapsed from the sending of the latest count value per roller rotation Na (step S3: YES), the CPU 72 returns to step S1.

When the CPU 72 of the head controller 67Ak determines that the specified time has not elapsed from the sending of the latest count value per roller rotation Na (step S3: NO), in step S1, the CPU 72 determines whether the printing for the web W is completed.

When the CPU 72 of the head controller 67Ak determines that the printing is not completed (step S4: NO), the CPU 72 returns to step S3. When the CPU 72 of the head controller 67Ak determines that the printing is completed (step S4: YES), the CPU 72 terminates the series of processes.

Although the count value per roller rotation Na sent by the CPU 72 is the latest count value per roller rotation Na measured by the per-roller rotation counter 81 in the aforementioned description, it may be an average value of the count values per roller rotation Na obtained in a specified time.

Moreover, although the aforementioned processing in the flowchart of FIG. 8 is described as the processing performed by the head controller 67Ak of the printer controller 66A, the same processing is performed al so by the head controller 67Bk of the printer controller 66B. Specifically, the CPU 72 of the head controller 67Bk obtains the count value per roller rotation Na from the per-roller rotation counter 81 in the FPGA 73 of the head controller 67Bk and sends the obtained count value per roller rotation Na to the head controllers 67 of the printer controller 66A, every specified time.

The count value per roller rotation Na sent by each of the head controllers 67Ak, 67Bk to the head controllers 67 for the opposite surface is written into the register 82 in the FPGA 73 by the CPU 72 in each of the head controllers 67 having received the count value per roller rotation Na, as the count value per roller rotation Nb for the opposite surface.

Specifically, the count value per roller rotation Na sent from the head controller 67Ak of the printer controller 66A to each of the head controllers 67 of the printer controller 66B is written into the register 82 as the count value per roller rotation Nb for the opposite surface in each head controller 67 of the printer controller 66B. Meanwhile, the count value per roller rotation Na sent from the head controller 67Bk of the printer controller 66B to each of the head controllers 67 of the printer controller 66A is written into the register 82 as the count, value per roller rotation Nb for the opposite surface in each head controller 67 of the printer controller 66A. The latest count value per roller rotation Nb is thus written in each register 82.

Next, correction value calculation processing for correcting the output pulse signal of each encoder 22 is described with reference to the flowchart of FIG. 9.

Figure 9:
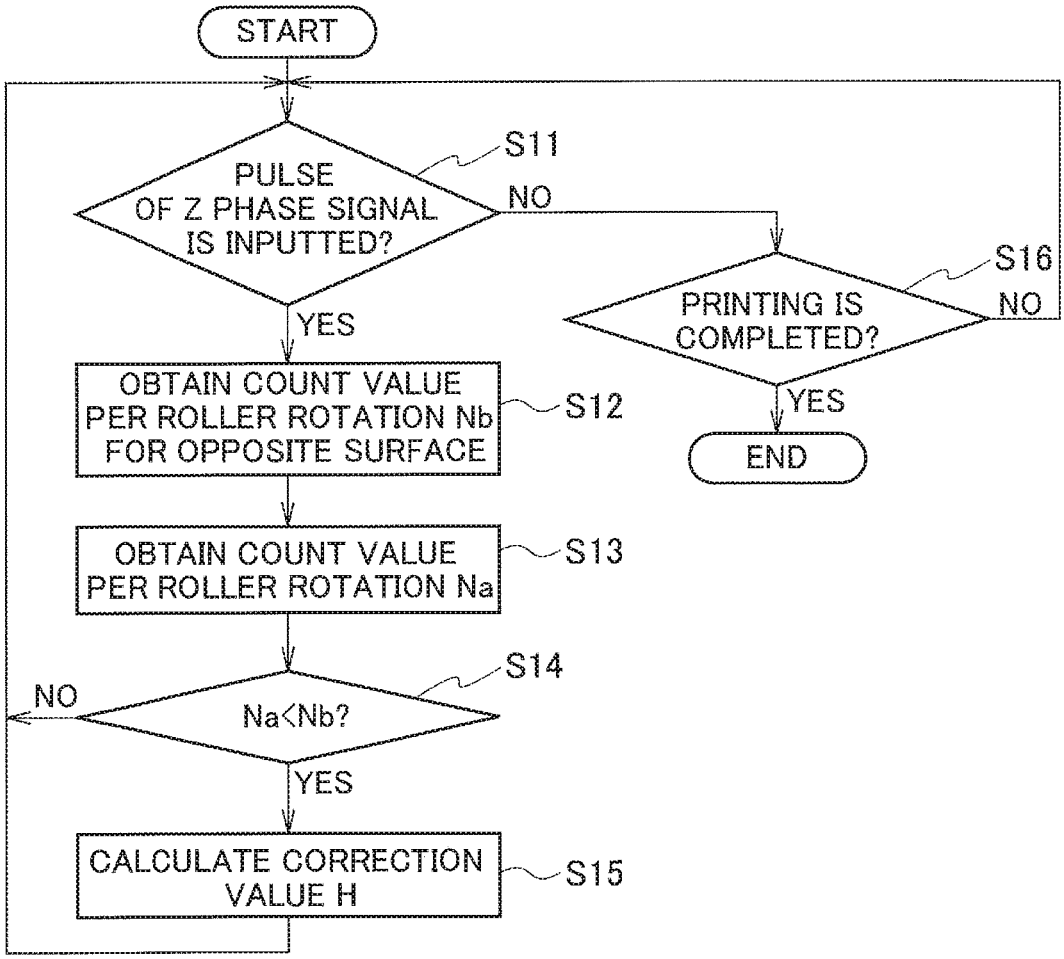
FIG. 9 is a flowchart of correction value calculation processing.

The processing in the flowchart of FIG. 9 starts when the constant speed conveyance of the web W at the print conveyance speed starts. The processing in the flowchart of FIG. 9 is performed in the FPGA 73 in each of the head controllers 67 of the printer controllers 66A, 66B.

In step S11 of FIG. 9, the correction value calculator 83 determines whether the pulse of the Z-phase signal of the encoder 22 is inputted into the FPGA 73. In this case, the correction value calculator 83 is notified of the input of the Z-phase signal into the FPGA 73 via the per-roller rotation counter 81.

When the correction value calculator 83 determines that the pulse of the Z-phase signal of the encoder 22 is inputted into the FPGA 73 (step S11: YES), in step S12, the correction value calculator 83 obtains the count value per roller rotation Nb for the opposite surface from the register 82.

Next, in step S13, the correction value calculator 83 obtains the count value per roller rotation Na of the head controller 67 including the correction value calculator 83 itself, from the per-roller rotation counter 81.

Then, in step S14, the correction value calculator 83 determines whether the count value per roller rotation Na is smaller than the count value per roller rotation Nb for the opposite surface (Na<Nb).

When the correction value calculator 83 determines that Na<Nb (step S14: YES), in step S15, the correction value calculator 83 calculates the correction value H.

Specifically, first, the correction value calculator 83 calculates a reference correct on amount Q and a correction value change pulse number R by using the following formulae (1) and (2).

$$Q=INT((Nb-Na)/P) \quad (1)$$

$$R=(Nb-Na)-P\times Q \quad (2)$$

The reference correction amount Q is a reference correction amount per period in the case of correcting the output pulse signal of the encoder 22. The reference correction amount Q is an integer portion of a quotient obtained by dividing a difference value (Nb−Na) between the count values per roller rotation Na, Nb by the number P of the output pulses of the encoder 22 for one rotation of the encoder roller 31.

The correction value change pulse number R indicates the number of pulses from the first pulse in the output pulse signal for one rotation of the encoder roller 31 to the pulse at which the correction value H is changed in the correction of the output pulse signal of the encoder 22. The correction value change pulse number R is a remainder in division of the aforementioned difference value (Nb−Na) by P.

Next, the correction value calculator 83 is determines the correction value H based on the reference correction amount Q and the correction value change pulse number R. Specifically, the correction value calculator 83 determines that the correction value H for the first to R-th pulses in the output pulse signal of the encoder 22 for one rotation of the encoder roller 31 is Q+1 and the correction value H for the (R+1)th to P-th pulses is Q.

After completing the calculation of the correction value H, the correction value calculator 83 returns to step S11.

When the correction value calculator 83 determines that Na≥Nb in step S14 (step S14: NO), the correction value calculator 83 skips step S15 and returns to step S11. As described later, when Na≥Nb, the correction of the output pulse signal of the encoder 22 is not performed and the correction value calculator 83 thus sets the correction value H to 0.

When the correction value calculator 83 determines that no pulse of the Z-phase signal of the encoder 22 is inputted into the FPGA 73 in step S11 (step S11: NO), in step S16, the correction value calculator 83 determines whether the printing on the web W is completed.

When the correction value calculator 83 determines that the printing is not completed (step S16: NO), the correction value calculator 83 returns to step S11. When the correction value calculator 83 determines that the printing is completed (step S16: YES), the correction value calculator 83 terminates the series of processes.

Next, the correction processing of the output pulse signal of the encoder 22 is described with reference to the flowchart of FIG. 10.

The correction processing of the output pulse signal of the encoder 22 is performed when the FPGA 73 in each of the head controllers 67 of the printer controller 66A, 66B determines that Na<Nb.

In this case, the magnitude relationship between the count values per roller rotation Na, Nb is basically determined depending on the magnitude relationship between the outer circumferential lengths of the encoder rollers 31A, 31B. As described above, the magnitude relationship between the outer circumferential lengths of the encoder rollers 31A, 31B is due to the mechanical tolerance and is constant. Accordingly, the magnitude relationship between the count values per roller rotation Na, Nb should also be constant in the printer controllers 66A, 66B. However, in the case where the difference in the outer circumferential length between the encoder rollers 31A, 31B is small or in a similar case, the magnitude relationship between the count values per roller rotation Na, Nb may vary due to an effect of variation in the conveyance speed of the web W or an effect of decentering of the encoder roller 31.

As described above, whether Na<Nb is determined by the correction value calculator 83. The correction value calculator 83 notifies the corrected pulse signal generator 86 of the result of this determination. When Na<Nb, the correction value H calculated in the correction value calculator 83 is also sent to the corrected pulse signal generator 86.

Figure 10:
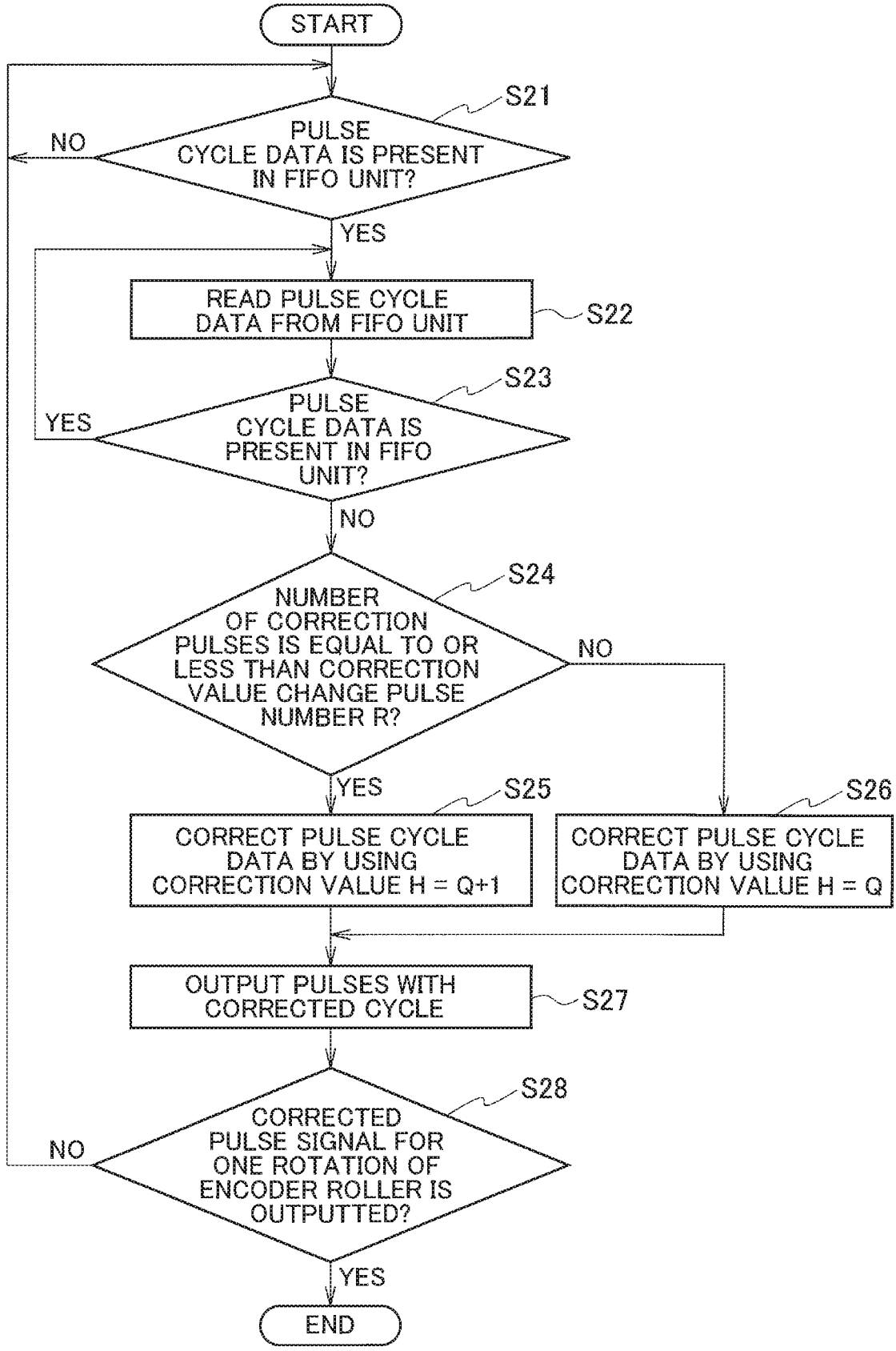
FIG. 10 is a flowchart of processing of correcting an output pulse signal of an encoder.

The processing in the flowchart of FIG. 10 starts when the correction value calculator 83 notifies the corrected pulse signal generator 86 that Na<Nb. The flowchart of FIG. 10 illustrates steps in correct on processing of the output pulse signal of the encoder 22 for one rotation of the encoder roller 31.

In step S21 of FIG. 10, the corrected pulse signal generator 86 determines whether there is the pulse cycle data in the FIFO unit 85.

Figure 11:
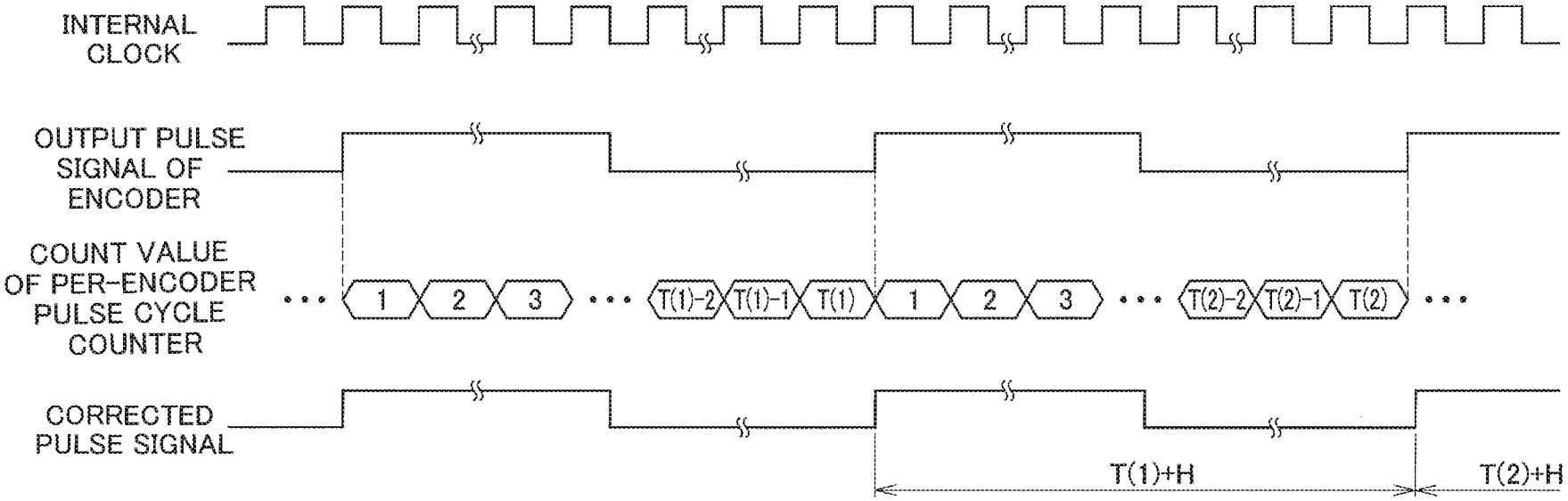
FIG. 11 is a view explaining a corrected pulse signal and an operation of measuring a pulse cycle in the output pulse signal of the encoder.

Note that, as illustrated in FIG. 11, during the print operation, the per-encoder pulse cycle counter 84 measures the pulse cycles in the output pulse signal of the encoder 22 one by one by counting the internal clock pulses of the FPGA 73. Then, the per-encoder pulse cycle counter. 84 sequentially stores pieces of pulse cycle data indicating the respective pulse cycles in order in the FIFO unit 85.

Returning to FIG. 10, when the corrected pulse signal generator 86 determines that there is no pulse cycle data in the FIFO unit 85 (step S21: NO), the corrected pulse signal generator 86 repeats step S21.

When the corrected pulse signal generator 86 determines that there is pulse cycle data in the FIFO unit 85 (step S21: YES), in step S22, the corrected pulse signal generator 86 reads the pulse cycle data for one cycle from the FIFO unit 85.

Next, in step S23, the corrected pulse signal generator 86 determines whether there is pulse cycle data in the FIFO unit 85.

Note that, as described later, pieces of pulse cycle data for multiple cycles are sometimes retained in the FIFO unit 85 as described later. Accordingly, in the FIFO unit 85 from which a piece of pulse cycle data is read in step S22, a piece of pulse cycle data of a subsequent cycle is held in some cases. The processing of step S23 is performed to skip reading of the old pulse cycle data in such a case. Specifically, when the corrected pulse signal generator 86 reads a piece of cycle data in step S22 and then determines that another piece of cycle data is still left in the FIFO unit 85 (step S23: YES), the corrected pulse signal generator 86 returns to step S22 and reads the pulse cycle data for one cycle from the FIFO unit 85.

When the corrected pulse signal generator 86 returns from step S23 to step S22 and reads the pulse cycle data again from the FIFO unit 85, the corrected pulse signal generator 86 discards the previously-read pulse cycle data. The corrected pulse signal generator 86 thereby obtains the latest pulse cycle data inputted into the FIFO unit 85.

When the corrected pulse signal generator 86 determines that there is no pulse cycle data in the FIFO unit 85 in step S23 (step S23: NO), in step S24, the corrected pulse signal generator 86 determines whether the number of correction pulses outputted since the start of the current correction processing for one rotation of the encoder roller 31 is the correction value change pulse number R or less. In this case, the number of correction pulses is the number of pulses (pulse cycle data) whose cycle is to be corrected in step S25 or S26 in a later stage.

When the corrected pulse signal generator 86 determines that the number of correction pulses is the correction value change pulse number R or less (step S24: YES), in step S25, the corrected pulse signal generator 86 corrects the pulse cycle data by using the correction value H=Q+1. Specifically, the corrected pulse signal generator 86 corrects the pulse cycle data such that the pulse cycle is extended by (Q+1) clock pulses. Thereafter, the corrected pulse signal generator 86 proceeds to step S27.

When the corrected pulse signal generator 86 determines that the number of correction pules is greater than the correction value change pulse number R (step S24: NO), in step S26, the corrected pulse signal generator 66 corrects the pulse cycle data by using the correction value H=Q. Specifically, the corrected pulse signal generator 86 corrects the pulse cycle data such that the pulse cycle is extended by Q clock pulses. Thereafter, the corrected pulse signal generator 86 proceeds to step S27.

In step S27, the corrected pulse signal generator 86 outputs the pulses for one cycle in the cycle corrected in step S25 or S26 to the inkjet head 56.

Next, in step S28, the corrected pulse signal generator 86 determines whether a corrected pulse signal with as many pulses as pulses (P pluses) for one rotation of the encoder roller 31 has been outputted since the start of current correction processing for one rotation of the encoder roller 31. In this case, as illustrated in the lowest section of FIG. 11, the corrected pulse signal is a signal including pulses whose pulse cycles T(1), T(2), . . . are corrected by using the correction value H in step S25 or S26.

When the corrected pulse signal generator 86 determines that the corrected pulse signal with as many pulses as pulses for one rotation of the encoder roller 31 has been outputted (step S28: NO), the corrected pulse signal generator 86 returns to step S21.

When the corrected pulse signal generator 86 determines that the corrected pulse signal with as many pulses as pulses for one rotation of the encoder roller 31 has been outputted (step S28: YES), the correction processing for one rotation of the encoder roller 31 is completed.

In the inkjet heads 56 which have received the corrected pulse signal generated in the aforementioned correction processing, the ink ejection based on the image data is performed at timings based on the corrected pulse signal.

By the aforementioned correction processing, the difference in the rotation cycle between the encoder rollers 31A, 31B is substantially evenly divided among the pulse cycles in the output pulse signal for one rotation of the encoder roller 31, the output pulse signal outputted by the encoder 22 corresponding to the encoder roller 31 with the shorter rotation cycle. Such correction processing reduces the difference in the pulse cycle between the output pulse signals of the encoders 22A, 22B and the pulse cycles in the output pulse signals are substantially aligned. This can reduce the case where the difference in the print length between the image on the front surface of the web and the image on the back surface of the web W occurs due to the difference in the outer circumferential length between the encoder rollers 31A, 31B.

In the aforementioned correction processing, the corrected pulse signal generator 86 reads the pieces of pulse cycle data in order from the FIFO unlit 85 and outputs the pulses whose pulse cycles are corrected. In this case, the corrected pulse signal generator 86 performs correction of extending each pulse cycle by the correction amount H. The pulse cycles in the corrected pulse signal are thus longer than those in the output pulse signal of the encoder 22. Accordingly, multiple pieces of pulse cycle data are sometimes retained in the FIFO unit 85.

Figure 12:
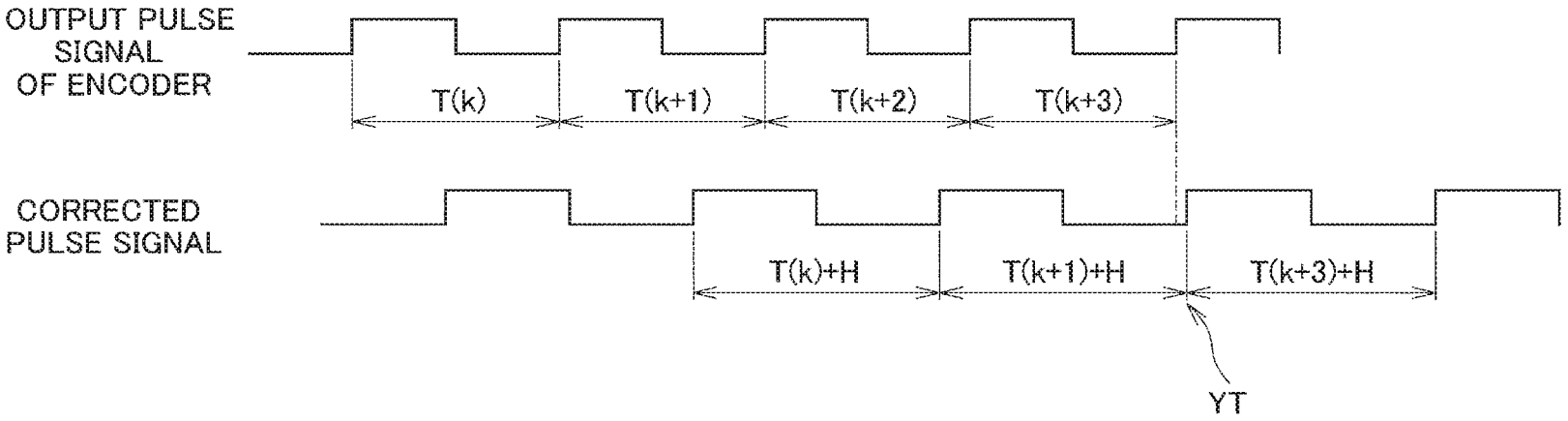
FIG. 12 is a view for explaining skipping of reading of pulse cycle data.

For example, in the example illustrated in FIG. 12, at a time point where the correction pulse in a cycle of (T(k+1)+H) for pulse cycle data T(k+1) is generated, two pieces of pulse cycle data T(k+2), T(k+3) are stored in the FIFO unit 85. In this case, the corrected pulse signal generator 86 skips reading of the pulse cycle data of T(k+2) (at the point of YT in FIG. 12) and generates the correction pulse in a cycle of (T(k+3)+H) for the pulse cycle data of T(k+3). The processing of step S23 in FIG. 10 is performed as described above to skip the reading of such cycle data.

The aforementioned correction processing is not performed when the FPGA 73 in each of the head controllers 67 of the printer controller 66A, 66B determines that Na≥Nb. When Na≥Nb, the corrected pulse signal generator 86 does not correct the pieces of pulse cycle data read in order from the FIFO unit 85 and outputs the pulse signal with unchanged pulse cycles. The output pulse signal of the encoder 22 is thereby outputted to the inkjet heads 56 without being corrected.

As described above, in the printing apparatus 3, the printing apparatus controller 24 controls the ejection timings of the inks in the printers 23A, 23B based on the output pulse signals of the encoders 22A, 22B, respectively. Shifting of landing positions of the inks between the inkjet heads 56 in the printer 23A and those in the printer 23B can be thereby suppressed. A decrease in print image quality can be thereby suppressed.

Moreover, the printing apparatus controller 24 corrects the output pulse signals of the encoders 22A, 22B based on the difference value between the rotation cycles of the encoder rollers 31A, 31B such that the difference in the pulse cycle between both output pulse signals is reduced. This suppresses the difference in the print length between the image on the front surface of the web W and the image on the back surface of the web W which occurs due to the difference in the outer circumferential length between the encoder rollers 31A, 31B. As a result, misalignment between the images printed on the front surface and the back surface of the web W can be reduced.

Accordingly, the printing apparatus 3 can reduce the misalignment between the images printed on the front surface and the back surface of the web W while suppressing the decrease in print image quality.

Moreover, in the printing apparatus 3, the printer controllers 66A, 66B are connected to each other via the communication bus 77. Each of the printer controllers 66A, 66B measures the rotation cycle of a corresponding one of the encoder rollers 31A, 31B and sends the rotation cycle measured by the printer controller 66 itself to the other printer controller 66 via the communication bus 77. Each of the printer controllers 66A, 66B calculates the difference value between the rotation cycle measured by the printer controller 66 itself and the rotation cycle received from the other printer controller 66. Then, each of the printer controllers 66A, 66B corrects the output pulse signal of a corresponding one the encoder 22A, 22B based on the calculated difference value such that the difference in the pulse cycle between both output pulse signals is reduced.

As described above, making the printer controllers 66A, 66B send the rotation cycles of the encoder rollers 31A, 31B measured by the printer controllers 66A, 66B themselves to each other allows the printer controllers 66A, 66B to calculate the difference value between the rotation cycles and correct the output pulse signals of the encoders 22A, 22B without addition of hardware which receives inputs from both encoders 22A, 22B.

Note that, in the aforementioned embodiment, each head controller 67 performs correction of extending the pulse cycle in the output pulse signal of the encoder 22 corresponding to the head controller 67 itself when the count value per roller rotation Na is smaller than the count value per roller rotation Nb for the opposite surface (Na<Nb). However, each head controller 67 may perform correction of shortening the pulse cycle in the output pulse signal of the encoder 22 corresponding to the head controller 67 itself when the count value per roller rotation Na is larger than the count value per roller rotation Nb for the opposite surface (Na>Nb).

Moreover, although the printing apparatus including the inkjet heads as the print mechanisms is described in the aforementioned embodiment, the print mechanisms may be mechanisms using other methods such as an electrophotographic method.

Furthermore, although the configuration in which the unwinder and the rewinder are connected to the printing apparatus as separate apparatuses is described in the aforementioned embodiment, the configuration may be such that the unwinder and the rewinder are incorporated in the printing apparatus.

The embodiments of the disclosure include, for example, the following configurations.

A printing apparatus includes: a first printer including first print mechanisms aligned in a conveyance direction of a web, the first printer being configured to print a first image on a first surface of the web being conveyed by using the first print mechanisms; a second printer including second print mechanisms aligned in the conveyance direction the second printer being configured to print a second image on a second surface of the web being conveyed by using the second print mechanisms; a first roller configured to rotate in synchronization with the web being conveyed; a second roller configured to rotate in synchronization with the web being conveyed; a first encoder configured to output a first pulse signal depending on a rotation angle of the first roller; a second encoder configured to output a second pulse signal depending on a rotation angle of the second roller; and a controller. The controller is configured to: receive the first pulse signal outputted from the first encoder and the second pulse signal outputted from the second encoder; generate a first corrected pulse signal by correcting the received first pulse signal or generate a second corrected pulse signal by correcting the received second pulse signal, based on a difference value between a first rotation cycle of the first roller and a second rotation cycle of the second roller such that a difference between a first pulse cycle of the received first pulse signal and a second pulse cycle of the received second pulse signal is reduced; upon generating the first corrected pulse signal, control first print timings in the respective first print mechanisms of the first printer based on the generated first corrected pulse signal; and upon generating the second corrected pulse signal, control second print timings in the respective second print mechanisms of the second printer based on the generated second corrected pulse signal.

The first encoder may be configured to output a first reference signal per rotation of the first roller, the second encoder may be configured to output a second reference signal per rotation of the second roller. The controller may include: a first printer controller configured to receive the first pulse signal and the first reference signal outputted from the first encoder; and a second printer controller connected to the first printer controller via a communication line and configured to receive the second pulse signal and the second reference signal outputted from the second encoder. The first printer controller may be configured to: measure the first rotation cycle based on the received first reference signal; and send the measured first rotation cycle to the second printer controller via the communication line. The second printer controller may be configured to: measure the second rotation cycle based on the received second reference signal; and send the measured second rotation cycle to the first print controller via the communication line. The first printer controller may be configured to determine based on the measured first rotation cycle and the second rotation cycle received from the second printer controller whether to correct the received first pulse signal. The second printer controller may be configured to determine based on the measured second rotation cycle and the first rotation cycle received from the first printer controller whether to correct the received second pulse signal. Upon determining to correct the received first pulse signal, the first printer controller may be configured to: calculate the difference value based on the first rotation cycle and the second rotation cycle; generate the first corrected pulse signal by correcting the received first pulse signal based on the calculated difference value such that the difference between the first pulse cycle and the second pulse cycle is reduced; and control the first print timings based on the generated first corrected pulse signal. Upon determining to correct the received second pulse signal, the second printer controller may be configured to: calculate the difference value based on the second rotation cycle and the first rotation cycle; generate the second corrected pulse signal by correcting the received second pulse signal based on the calculated difference value such that the difference between the first pulse cycle and the second pulse cycle is reduced; and control the second print timings based on the generated second corrected pulse signal.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a first printer including first print mechanisms aligned in a conveyance direction of a web, the first printer being configured to print a first image on a first surface of the web being conveyed by using the first print mechanisms;

a second printer including second print mechanisms aligned in the conveyance direction the second printer being configured to print a second image on at second surface of the web being conveyed by using the second print mechanisms;

a first roller configured to rotate in synchronization with the web being conveyed;

a second roller configured to rotate in synchronization with the web being conveyed;

a first encoder configured to output a first pulse signal depending on a rotation angle of the first roller;

a second encoder configured to output a second pulse signal depending on a rotation angle of the second roller; and a controller configured to receive the first pulse signal outputted from the first encoder and the second pulse signal outputted from the second encoder, generate a first corrected pulse signal by correcting the received first pulse signal or generate a second corrected pulse signal by correcting the received second pulse signal, based on a difference value between a first rotation cycle of the first roller and a second rotation cycle of the second roller such that a difference between a first pulse cycle of the received first pulse signal and a second pulse cycle of the received second pulse signal is reduced, upon generating the first corrected pulse signal, control first print timings in the respective first print mechanisms of the first printer based on the generated first corrected pulse signal, and upon generating the second corrected pulse signal, control second print timings in the respective second print mechanisms of the second printer based on the generated second corrected pulse signal.

2. The printing apparatus according to claim 1, wherein the first encoder is configured to output a first reference signal per rotation of the first roller, the second encoder is configured to output a second reference signal per rotation of the second roller, the controller comprises a first printer controller configured to receive the first pulse signal and the first reference signal outputted from the first encoder; and a second printer controller connected to the first printer controller via a communication line and configured to receive the second pulse signal and the second reference signal outputted from the second encoder, the first printer controller s configured to:

measure the first rotation cycle based on the received first reference signal; and send the measured first rotation cycle to the second printer controller via the communication line, the second printer controller is configured to:

measure the second rotation cycle based on the received second reference signal; and send the measured second rotation cycle to the first print controller via the communication line, the first printer controller is configured to determine based on the measured first rotation cycle and the second rotation cycle received from the second printer controller whether to correct the received first pulse signal, the second printer controller is configured to determine based on the measured second rotation cycle and the first rotation cycle received from the first printer controller whether to correct the received second pulse signal, upon determining to correct the received first pulse signal, the first printer controller is configured to:

calculate the difference value based on the first rotation cycle and the second rotation cycle;

generate the first corrected pulse signal by correcting the received first pulse signal based on the calculated difference value such that the difference between the first pulse cycle and the second pulse cycle is reduced; and control the first print timings based on the generated first corrected pulse signal, and upon determining to correct the received second pulse signal, the second printer controller is configured to:

calculate the difference value based on the second rotation cycle and the first rotation cycle;

generate the second corrected pulse signal by correcting the received second pulse signal based on the calculated difference value such that the difference between the first pulse cycle and the second pulse cycle is reduced; and control the second print timings based on the generated second corrected pulse signal.

* * * * *